US010400373B2

(12) United States Patent
Ruzek et al.

(10) Patent No.: US 10,400,373 B2
(45) Date of Patent: Sep. 3, 2019

(54) HIGH-STRENGTH LIGHTWEIGHT NON-WOVEN FABRIC MADE OF SPUNBONDED NON-WOVEN, METHOD FOR THE PRODUCTION THEREOF AND USE THEREOF

(71) Applicant: CARL FREUDENBERG KG, Weinheim (DE)

(72) Inventors: Ivo Ruzek, Kaiserslautern (DE); Ararad Emirze, Kaiserslautern (DE)

(73) Assignee: CARL FREUDENBERG KG, Weinheim (DE)

( * ) Notice: Subject to any disclaimer, the term of this patent is extended or adjusted under 35 U.S.C. 154(b) by 188 days.

(21) Appl. No.: 15/267,227

(22) Filed: Sep. 16, 2016

(65) Prior Publication Data

US 2017/0002487 A1 Jan. 5, 2017

Related U.S. Application Data

(62) Division of application No. 12/525,148, filed as application No. PCT/EP2008/000767 on Jan. 31, 2008, now Pat. No. 9,458,558.

(30) Foreign Application Priority Data

Jan. 31, 2007 (EP) ..... 07002061

(51) Int. Cl.

| | |
|---|---|
| ***D04H 3/11*** | (2012.01) |
| ***D04H 3/12*** | (2006.01) |
| ***D04H 3/14*** | (2012.01) |
| ***D04H 3/011*** | (2012.01) |
| ***D04H 13/00*** | (2006.01) |
| ***D01D 5/098*** | (2006.01) |

(52) U.S. Cl.

CPC ..... *D04H 3/11* (2013.01); *D01D 5/0985* (2013.01); *D04H 3/011* (2013.01); *D04H 3/12* (2013.01); *D04H 3/14* (2013.01); *D04H 13/00* (2013.01); *Y10T 428/23979* (2015.04); *Y10T 442/681* (2015.04)

(58) Field of Classification Search

CPC ..... D04H 3/11; D04H 3/12

See application file for complete search history.

(56) References Cited

U.S. PATENT DOCUMENTS

| | | | | |
|---|---|---|---|---|
| 3,485,706 | A * | 12/1969 | Evans | D04H 18/04 162/115 |
| 3,975,224 | A | 8/1976 | Ruzek et al. | |
| 4,093,763 | A | 6/1978 | Hartmann et al. | |
| 5,334,446 | A * | 8/1994 | Quantrille | D01G 25/00 442/35 |
| 5,804,286 | A | 9/1998 | Quantrille et al. | |
| 5,939,016 | A * | 8/1999 | Mathiesen | B22D 41/60 222/593 |
| 6,594,874 | B1 | 7/2003 | Fleissner | |
| 2003/0213546 | A1 | 11/2003 | Hartgrove | |
| 2004/0084134 | A1 | 5/2004 | Tai | |
| 2006/0154020 | A1 | 7/2006 | Kasuya et al. | |
| 2008/0026176 | A1 | 1/2008 | Aulbach | |
| 2008/0308490 | A1 | 12/2008 | Greiner et al. | |
| 2010/0075120 | A1 | 3/2010 | Gustafsson | |

FOREIGN PATENT DOCUMENTS

| | | | |
|---|---|---|---|
| CA | 2676824 | | 8/2008 |
| DE | 2240437 | | 8/1972 |
| DE | 19821848 | | 11/1999 |
| DE | 19821848 | A1 * | 11/1999 |
| EP | 0534863 | A1 * | 3/1993 |
| GB | 1244754 | | 9/1971 |
| JP | 6-128852 | | 5/1994 |
| JP | 7-194475 | | 8/1995 |
| JP | 10-165207 | | 6/1998 |
| JP | 10-251960 | | 9/1998 |
| JP | 11-247058 | | 9/1999 |
| JP | 2004-97683 | | 4/2004 |
| JP | 2004-305341 | | 11/2004 |
| JP | 2005-15990 | | 1/2005 |
| KR | 1998-061102 | | 10/1998 |
| KR | 2002-0059939 | | 7/2002 |
| RU | 2184516 | | 10/2002 |
| TW | 200516123 | | 5/2005 |
| WO | 98/27920 | | 7/1998 |
| WO | 2005/047585 | | 5/2005 |
| WO | 2006/105836 | | 10/2006 |

OTHER PUBLICATIONS

Machine Translation of German Patent DE 19821848, Date Unknown.*
Adanur, Sadit. Wellington Sears Handbook of Industrial Textiles. Technomic Publishing Company, Inc. Lancaster, PA. pp. 596-597.
International Preliminary Report on Patentability dated Aug. 4, 2008. Issued in related PCT Application No. PCT/EP2008/000767.

* cited by examiner

*Primary Examiner* — Jeffry H Aftergut
(74) *Attorney, Agent, or Firm* — Grossman, Tucker Perreault & Pfleger, PLLC

(57) ABSTRACT

The invention relates to a high-strength light-weight non-woven fabric made of spunbonded non-woven, particularly for use as a reinforcement or strengthening material, comprising at least one ply of melt-spun synthetic filaments, which are bonded by means of high-energy water jets, characterized in that it includes a thermally activatable binding agent, which is applied onto the ply of melt-spun filaments in the form of at least one thin layer. The invention further relates to a method for producing such a non-woven fabric.

18 Claims, No Drawings

HIGH-STRENGTH LIGHTWEIGHT NON-WOVEN FABRIC MADE OF SPUNBONDED NON-WOVEN, METHOD FOR THE PRODUCTION THEREOF AND USE THEREOF

FIELD OF THE INVENTION

The invention relates to a high-strength lightweight non-woven fabric made of spunbonded non-woven, which comprises at least one layer of melt-spun synthetic filaments, which are bonded by means of high-energy water jets. The invention further relates to a method for producing such a non-woven fabric and to the use thereof.

SUMMARY

An object of the invention is to provide a high-strength light-weight non-woven fabric made of spunbonded non-woven, which stands out not only by high strength, but also by a high initial modulus. A high initial modulus reduces the proneness to initial deformation and the resulting lateral contraction during the conventional industrial processing steps.

This object is achieved by a non-woven fabric made of spunbonded non-woven as described herein. A method for producing a non-woven fabric according to the invention made of spunbonded non-woven is also described herein, and a preferred use of the invention is also described herein.

According to the invention, it is provided for a high-strength light-weight non-woven fabric made of spunbonded non-woven, having at least one ply of melt-spun synthetic filaments bonded by means of high-energy water jets, that this fabric comprises a thermally activatable binding agent, which is applied onto the ply of melt-spun filaments in the form of at least one thin layer.

During the interlacing of the threads by the high-energy water jets, a plurality of very weak cohesive bonds are produced across the cross-section of the non-woven fabric. Each of these bonds based solely on interfacial cohesion is very weak per se, and in any case weaker than the strength of the threads connected in this way. If a sufficiently high force that is caused by an industrial processing step acts on a spunbonded non-woven fabric bonded in this way, the weak cohesive bonds produced by the hydroentangling step are individually overloaded and loosened, without damaging the constituent threads. Only when the load is distributed to a sufficient wide surrounding area and all undamaged supporting threads are oriented in the load direction does the sum of the individual weak bond strengths have an effect, and yet the non-woven fabric has high strength.

The initial resilience is manifested on the stress-elongation diagram as a low initial modulus. In practical use, with the appropriate load this results in longitudinal deformation, in conjunction with a corresponding lateral contraction. This hampers the application of such water jet-bonded spunbonded non-woven fabrics, or at times even prevents it.

An increase in the initial modulus consequently appears to be a paramount technical task. Surprisingly it was found that by applying at least one thin layer of a binding agent onto the ply of melt-spun synthetic filaments, together with the subsequent hydroentangling, drying, and activation of the binding agent, further bonds (or bonding sites)—in addition to the water jet bonds—are created between the spunbonded non-woven filaments. As a result, a strange combination of a very high number of weak cohesive bonds and a much lower number of considerably stronger adhesive bonds is created.

This high number of fine spun-bonded non-woven filaments bonded to each other by the above-mentioned additional bonding sites contributes to the fact that the non-woven fabric has high modulus values and a dimensional stability that is sufficient for further processing. With the non-woven fabric according to the invention no further measures for dimensional stabilization, such as tension control, are required during further processing. It is suspected that this effect, among other things, can also be attributed to the fact that part of the binding agent is also carried down into the deeper layers of the non-woven fabric ply by the high-energy water jets and forms bonding sites there.

A non-woven fabric according to the invention may be composed of one, or also several plies of spunbonded non-woven and binding agent. Other additional plies may also be provided, to the extent they are useful for the respective application.

In particular low-melting thermoplastic polymers are suited as binding agents, wherein such thermoplastic polymers are preferred, the melting temperatures of which are sufficiently lower than those of the spun-bonded non-woven filaments. The melting temperature should preferably be at least 10° C., in a particularly preferred embodiment at least 20° C. below the melting temperature of the spun-bonded non-woven filaments, so that they are not damaged during the thermal activation.

In a preferred embodiment, the low-melting thermoplastic polymers also have a broad softening range. This has the advantage that the thermoplastic polymer used as the binding agent can be activated at lower temperatures than the effective melting point thereof. From a technological point of view, the binding agent does not necessarily have to be fully melted, but instead it suffices that it is sufficiently softened, thereby adhering to the filaments to be bound. In this way, during the activation phase the binding degree between the spun-bonded non-woven filaments and the binding agent can be adjusted.

The low-melting thermoplastic polymer preferably substantially comprises a polyolefin, particularly polyethylene, a copolymer having a substantial proportion of polyethylene, polypropylene, a copolymer having a substantial proportion of polypropylene, a copolyester, particularly polypropylene terephthalate and/or polybutylene terephthalate, a polyamide and/or a copolyamide. During the selection of the suitable low-melting polymers, the requirements of the subsequent specific application should be taken into consideration.

The weight proportion of the low-melting polymer relative to the total weight of the non-woven fabric is preferably greater than or equal to 7%. If the proportion of the hot-melt adhesive is too low, the strengthening of the initial modulus will be too low and perhaps not suffice for the future application.

The weight proportion is preferably between 9 and 15% by weight. If 15% by weight is exceeded, it is possible that the negative influence of the high number of strong adhesive bonds can get the upper hand on the resistance to tear propagation.

However, even the use of smaller proportions of hot-melt adhesive below 7% is advantageous, particularly for certain applications, and should therefore be encompassed by the present invention.

The low-melting polymer can be present, for example, in the form of fibers or fibrils. In particular conjugate fibers can be used as the fibers, wherein the lower-melting component constitutes the thermally activatable binding agent.

The present invention enables the use of filaments having a low titer of the spun-bonded non-woven filaments. Even with low basis weights, good strength and sufficient coverage is achieved. The fiber titer preferably ranges between 0.7 and 6 dtex. Fibers having a titer between 1 and 4 dtex have the special advantage that they both ensure good surface coverage with average basis weights and have sufficient overall strength.

A non-woven fabric according to the invention preferably includes filaments comprising polyester, particularly polyethylene terephthalate, and/or polyolefin, particularly polypropylene. These materials are particularly suited because they are produced from mass raw materials, which are available anywhere in sufficient quantities and sufficient quality. Both polyester and polypropylene are well-known in the production of fibers and non-woven fabrics for their durability.

In order to meet specific requirements of technical non-woven fabrics, such as a high initial modulus and/or rigidity and/or UV resistance and/or alkali resistance, in addition to PET (polyethylene terephthalate) it is also possible to use PEN (polyethylene naphthalate) and/or copolymers and/or mixtures of PET and PEN as the matrix fiber polymer. Compared to PET, PEN is characterized by a higher melting point (approximately +18° C.) and a higher glass transition temperature (approximately +45° C.).

A suitable method for producing a non-woven fabric according to the invention comprises the following steps:

a) Depositing at least one ply of synthetic filaments by means of a spun-bonded non-woven production process;
b) applying at least one thin layer comprising a thermally activatable binding agent.
c) distributing the binding agent and bonding the spun-bonded non-woven filaments by means of high-energy high-pressure water jets;
d) drying
e) thermal treatment in order to activate the binding agent.

The production of spunbonded non-wovens, which is to say the spinning of synthetic fibers from different polymers, including polypropylene or polyester, and also the deposition thereof to form a random non-woven on a carrier are state of the art. Large machines having widths of 5 m and more can be purchased from several companies. They can have one or more spinning systems (spin-die manifolds) and be adjusted to the desired output. Hydroentangling systems for water jet bonding are also state of the art. Such machines as well can be provided by several manufacturers in large widths. The same applies to dryers and winders.

The thermally activatable binding agent can be applied by different methods, such as by powder application, or also in the form of a dispersion. The binding agent, however, is preferably applied in the form of fibers or fibrils using a melt-blown or air-laying method. These methods too are known and described in many places in literature.

Melt-blown and air-laying methods have the particular advantage that they can be arbitrarily combined with spinning systems for the spunbonded non-woven filaments.

As is known from DE 198 21 848 C2, hydroentangling should be carried out such that a specific longitudinal strength of preferably 4.3 N/5 cm per g/m$^2$ of the surface mass and an initial modulus, measured in the longitudinal direction as tension for 5% elongation, of at least 0.45 N/5 cm per g/m$^2$ surface mass can be achieved. In this way, sufficient strength of the spunbonded non-woven fabric and sufficiently good distribution of the binding agent in the spunbonded non-woven ply are ensured.

Activation as defined by the invention shall denote the creation of bonding sites using the binding agent, for example by melting a low-melting polymer used as the binding agent for deposition or adherence. Both the drying operation and the thermal treatment for activation are to be carried out at temperatures that are so low that damage to the spunbonded non-woven filaments, for example as a result of melting for deposition or adherence, is safely avoided. For economical reasons with respect to the method, the drying operation and the thermal activation of the binding agent are preferably carried out in one step.

In order to dry and activate the low-melting polymer, different types of dryers may be used, such as tenters, belt driers, or surface driers, preferably however a drum dryer is suited. During the end phase, the drying temperature should preferably be adjusted to the melting temperature of the low-melting polymer and optimized as a function of the results. Here, particularly the entire melting behavior of the binding agent must be taken into account. When using one that has a pronounced wide softening range, it is not necessary to aim for the physical melting point. Rather, it suffices to look for the optimization of the binding effect already in the softening range. In this way, unpleasant marginal effects, such as adhesion of the binding component to machine parts and over-bonding, can be avoided.

Due to the excellent strength and the high initial modulus thereof, the non-woven fabric according to the invention is suited for applications in the technical field, particularly as a coating carrier, reinforcement or strengthening material.

The invention will be explained in more detail hereafter based on the exemplary embodiments:

EXAMPLE 1

The test machine for the production of spunbonded non-wovens had a width of 1200 mm. It included a spinneret, which extended across the entire width of the machine, two mutually opposed blow walls disposed parallel to the spinneret, and an extraction gap connecting thereto, which in the lower region expanded into a diffuser and formed a non-woven forming chamber. The spun filaments formed a uniform fabric, which is to say a spunbonded non-woven, on a collection belt suctioned downwardly in the non-woven forming region. Said non-woven was pressed together between two rolls and rolled up.

The pre-bonded spunbonded non-woven was unrolled on a test machine for hydroentangling. With the help of an air-laying system, on the surface thereof a thin layer of short bonding fibers was applied, and the two-layer textile was subsequently treated with a plurality of high-energy water jets, thereby hydroentangled and bonded. At the same time, the binding agent was distributed in the textile. Thereafter, the bonded multi-layer non-woven was dried in a drum dryer, wherein in the end zone of the dryer the temperature was adjusted such that the bonding fibers were activated and brought about additional binding.

In this experiment, a spunbonded non-woven was produced from polypropylene. A spinneret was used, which had 5479 spinning holes across the width described above. The raw material used was polypropylene granules from Exxon Mobile (Achieve PP3155), having an MFI of 36. The spinning temperature was 272° C. The extraction gap had a width of 25 mm. The filament titer was 2.1 dtex, measured based on the diameter in the spunbonded non-woven. The production speed was adjusted to 46 m/min. The resulting spunbonded non-woven had a basis weight of 70 g/m$^2$. On the hydroentangling machine, first a layer of 16 g/m$^2$ comprising very short conjugate fibers in a shell/core configuration was applied with the aid of a device for non-woven formation under an air current, wherein the core was made of polypropylene and the shell of polyethylene. The weight ratio of the components was 50/50%. Thereafter, the spunbonded non-woven was subjected to the hydroentangling step. The bonding was carried out with the help of 6 manifolds, with alternately acted upon both sides. The water pressure used in each case was adjusted as follows:

| | Manifold no. | | | | | |
|---|---|---|---|---|---|---|
| | 1 | 2 | 3 | 4 | 5 | 6 |
| Water pressure (bar) | 20 | 50 | 50 | 50 | 150 | 150 |

During the hydroentangling step, the short fibers were largely drawn into the spunbonded non-woven, so that they did not form a true surface layer.

Thereafter, the spunbonded non-woven treated with water jets was dried in a drum dryer. In the last zone, the air temperature was adjusted to 123° C., so that the polyethylene melted easily and formed thermal bonds. The spunbonded non-woven bonded in this way had the following mechanical values for a basis weight of 86 g/m$^2$:

| | Maximum tensile force [N/5 cm] | Maximum tensile elongation [%] | Force at 5% elongation [N/5 cm] | Force at 10% elongation [N/5 cm] |
|---|---|---|---|---|
| longitudinal | 512 | 85 | 56 | 93 |
| transverse | 86 | 105 | 6.0 | 11.9 |

The specific strength in the longitudinal direction was 5.95 N/5 cm per g/m$^2$ and the specific secant modulus at 5% elongation was 0.65 N/5 cm per g/m$^2$.

EXAMPLE 2

Polyester granules were used on the same test machine as described in Example 1. These granules had an intrinsic viscosity of IV=0.67. They were thoroughly dried, so that the residual water content was below 0.01% and spinning was carried out at a temperature of 285° C. In the process, as in Example 1, a spinneret having 5479 holes across a width of 1200 mm was used. The polymer throughput was 320 kg/h. In the spunbonded non-woven, the filaments had a visually determined titer of 2 dtex and very low shrinkage. The machine speed was adjusted to 61 m/min, so that the pre-bonded spunbonded non-woven had a basis weight of 72 g/m$^2$.

The non-woven was placed in the same machine for hydroentangling. A layer of 16 g/m$^2$ of the same short conjugate fibers (PP/PE 50/50) was placed on the surface of the pre-bonded spunbonded non-woven. Thereafter, the multi-layer material ran through the hydroentangling step using 6 manifolds, which were adjusted as follows:

| | Manifold no. | | | | | |
|---|---|---|---|---|---|---|
| | 1 | 2 | 3 | 4 | 5 | 6 |
| Water pressure (bar) | 20 | 50 | 80 | 80 | 200 | 200 |

During the hydroentangling step, the short bonding fibers were largely drawn into the spunbonded non-woven, so that they did not form a true surface layer.

Thereafter, the spunbonded non-woven treated with water jets was dried in a drum dryer. In the last zone, the air temperature was set to 123° C., so that the polyethylene melted easily and formed thermal bonds. The spunbonded non-woven bonded in this way had the following mechanical values for a basis weight of 87 g/m$^2$:

| | Maximum tensile force [N/5 cm] | Maximum tensile elongation [%] | Force at 5% elongation [N/5 cm] | Force at 10% elongation [N/5 cm] |
|---|---|---|---|---|
| longitudinal | 530 | 88 | 59 | 96 |
| transverse | 93 | 100 | 6.1 | 12.6 |

The specific strength in the longitudinal direction was 6.09 N/5 cm per g/m$^2$ and the specific secant modulus at 5% elongation was 0.68 N/5 cm per g/m$^2$.

What is claimed is:

1. A method for producing a high-strength light-weight non-woven fabric characterized by the following steps:

a) depositing at least one ply of spun-bonded melt-spun synthetic filaments by means of a spun-bonded non-woven production process;

b) applying at least one thin layer of a thermally activatable binding agent to said at least one ply;

c) hydroentangling the at least one ply in the presence of the thermally activatable binding agent using high-energy high-pressure water jets to form a resulting structure in which the synthetic filaments are hydroentangled, said binding agent is drawn into and distributed within said at least one ply, and said binding agent does not form a true surface layer on a surface of said at least one ply;

d) drying and thermally treating the resulting structure to activate the binding agent and form said non-woven fabric, wherein:

cohesive bonds are present in said non-woven fabric between said spun-bonded melt-spun synthetic filaments;

at least a portion of said binding agent is thermally bonded to said spun-bonded melt-spun synthetic filaments to form adhesive bonds distributed within the non-woven fabric, the adhesive bonds being relatively strong compared to said cohesive bonds;

said non-woven fabric exhibits a specific strength of at least 4.3 N/5 cm per g/m$^2$ basis weight and a specific initial modulus, measured in the longitudinal direction as tension at 5% elongation, of at least 0.45 N/5 cm per g/m$^2$ basis weight;

said specific strength is defined by dividing the maximum tensile strength (in N/5 cm) of the non-woven fabric by its area density (in g/m$^2$); and said specific initial modulus is defined by dividing the tensile strength of the non-woven fabric at 5% elongation (in N/5 cm) by its area density (in g/m$^2$).

2. The method according to claim 1, wherein the drying and thermal treating are carried out at the same time.

3. The method according to claim 1, wherein:

said spun-bonded melt-spun synthetic filaments have a first melting point;

said binding agent comprises a thermoplastic polymer having a second melting point; and the second melting point is less than the first melting point.

4. The method according to claim 1, wherein the thermally activatable binding agent is applied by employing an air-laying or melt-blown method.

5. The method of claim 3, wherein the second melting point is at least 10° C. lower than the first melting point.

6. The method of claim 1, wherein the synthetic filaments have a titer of 0.7 to 6.0 dTex.

7. The method of claim 1, wherein the synthetic filaments comprise polyester, polyethylene terephthalate (PET), polyethylene napthalate, a copolymer of PET and PEN, a mixture of PET and PEN, and/or a polyolefin.

8. The method of claim 3, wherein the thermoplastic polymer comprises a polyolefin, polyethylene, a copolymer including polyethylene, polypropylene, a copolymer including polypropylene, a copolyester, polypropylene terephthalate, polybutylene terephthalate, a polyamide, and/or a copolyimide.

9. The method of claim 3, wherein the non-woven fabric has a basis weight of 70 $g/m^2$ to 86 $g/m^2$.

10. The method of claim 3, wherein applying at least one thin layer of said thermally activatable binding agent to said at least one ply comprises applying particles of said thermoplastic polymer to said at least one ply.

11. The method of claim 3, wherein applying at least one thin layer of said thermally activatable binding agent to said at least one ply comprises applying a melt-blown fibers or fibrils of said thermoplastic polymer to said at least one ply.

12. The method of claim 11, wherein said melt-blown fibers or fibrils are applied to said at least one ply using air.

13. The method of claim 3, wherein applying at least one thin layer of said thermally activatable binding agent to said at least one ply comprises applying melt-blown conjugate fibers comprising said thermoplastic polymer to said at least one ply.

14. The method of claim 1, wherein said fabric comprises a higher number of said cohesive bonds than said adhesive bonds.

15. The method of claim 14, wherein the synthetic filaments have a titer of 0.7 to 6.0 dTex.

16. The method of claim 5, wherein said binding agent is present in an amount ranging from greater than or equal to 9% by weight to less than 15% by weight, relative to the total weight of the non-woven fabric.

17. The method of claim 16, wherein said spun-bonded melt-spun synthetic filaments comprise polyethylene napthalate having a titer of 0.7 dtex to 6 dtex.

18. The method of claim 1, wherein said binding agent is present in an amount ranging from greater than or equal to 7% by weight to less than 15% by weight, relative to the total weight of the non-woven fabric.

* * * * *